US005286122A

United States Patent [19]

Jung et al.

[11] Patent Number: 5,286,122

[45] Date of Patent: Feb. 15, 1994

[54] RIBBON CARTRIDGE WITH TAKE-UP ARM

[75] Inventors: Gregory M. Jung, Charlotte, N.C.; Keith Smith, Shelbyville, Tenn.

[73] Assignee: Datasouth Computer Corporation, Charlotte, N.C.

[21] Appl. No.: 66,876

[22] Filed: May 25, 1993

[51] Int. Cl.[5] ..... B41J 35/28

[52] U.S. Cl. ..... 400/196.1; 400/208

[58] Field of Search ..... 400/207, 208, 208.1, 400/196, 196.1, 195, 248

[56] References Cited

U.S. PATENT DOCUMENTS

| | | | |
|---|---|---|---|
| 3,899,065 | 8/1975 | Brignole | 400/208 |
| 4,134,693 | 1/1979 | Crickmore et al. | 400/208 |
| 4,188,134 | 2/1980 | Garrido | 400/208 |
| 4,227,820 | 6/1980 | Falcetti | 400/196.1 |
| 4,280,767 | 7/1981 | Heath | 400/196.1 |
| 4,352,575 | 10/1981 | Shore | 400/208 |
| 4,576,791 | 12/1985 | Nagashima | 400/208 |
| 4,630,948 | 12/1986 | Karns | 400/196.1 |
| 4,636,097 | 1/1987 | Goubeaux | 400/196.1 |
| 4,728,207 | 3/1988 | Foster | 400/248 |
| 4,729,677 | 3/1988 | Dirla et al. | 400/208 |
| 4,806,033 | 2/1989 | Ukmar et al. | 400/208 |
| 4,875,789 | 10/1989 | Sato | 400/196.1 |
| 4,880,323 | 11/1989 | Milliser et al. | 400/196.1 |
| 4,955,737 | 9/1990 | Haftmann et al. | 400/208 |
| 4,983,056 | 1/1991 | Falconieri et al. | 400/208 |
| 5,005,996 | 4/1991 | Paterra et al. | 400/208 |
| 5,127,750 | 7/1992 | Burgin | 400/208 |
| 5,160,204 | 11/1992 | Naito et al. | 400/208 |
| 5,160,206 | 11/1992 | Haftmann et al. | 400/208 |

*Primary Examiner*—Eugene H. Eickholt

*Attorney, Agent, or Firm*—John F. A. Earley; John F. A. Earley, III

[57] ABSTRACT

A ribbon cartridge for a printer is provided with a take-up arm that is thin enough to fit into an extremely tight space of the printer, and has a support stub which supports the lower edge of the ribbon, an upper guide finger which guides the upper edge of the ribbon, and a lower guide finger which guides the lower edge of the ribbon.

2 Claims, 3 Drawing Sheets

FIG. 2
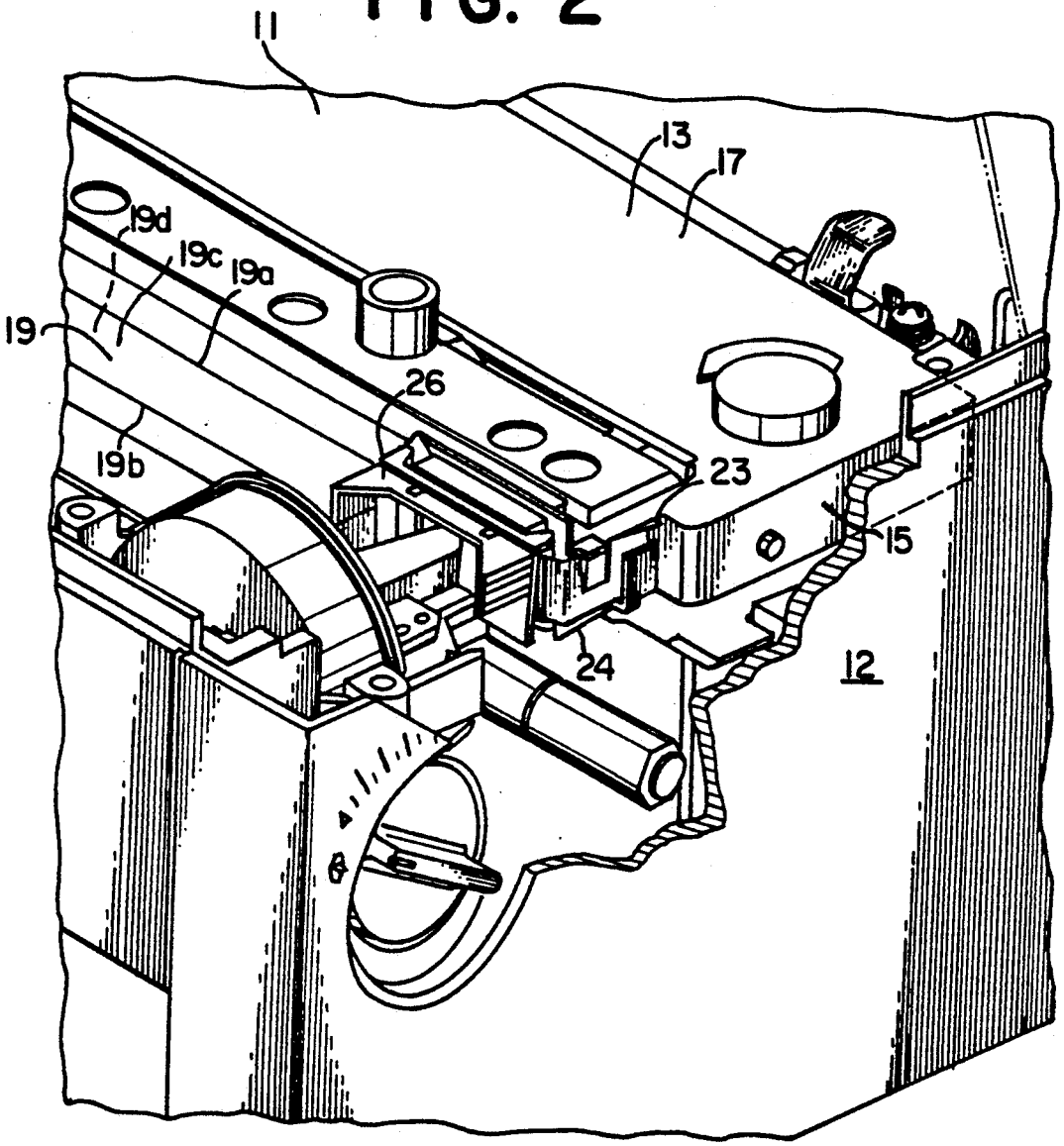
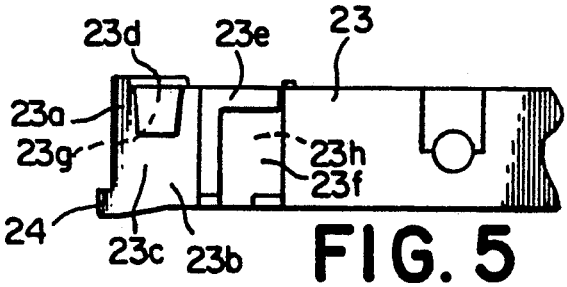
FIG. 5

RIBBON CARTRIDGE WITH TAKE-UP ARM

BACKGROUND OF THE INVENTION

1. Field of the Invention

This invention relates to ribbon cartridges or cassettes for printers, and more particularly concerns ribbon cartridges for dot matrix printers, which ribbon cartridges have take-up arms that function properly in extremely space-sensitive areas.

2. Description of the Prior Art

Ribbon cartridges in the prior art have been provided with take-up arms which are either too large for space-sensitive applications, or do not adequately support the ribbon fabric to prevent twisting during handling and operation.

SUMMARY OF THE INVENTION

It is an object of this invention to overcome the disadvantages of the prior art, and to provide a ribbon cartridge with a take-up arm which is fully operable in a space-sensitive area.

It is another object to provide a ribbon cartridge with a narrow take-up arm which adequately supports the ribbon fabric and prevents twisting during handling and operation.

BRIEF DESCRIPTION OF THE DRAWINGS

FIG. 2 is the same as FIG. 1 except that a pulley which is shown next to the take-up arm in FIG. 1 has been omitted in order to show the take-up arm more clearly.

FIG. 5 is a partial view in elevations of the outer portion of the take-up arm of the ribbon cartridge.

DETAILED DESCRIPTION OF THE DRAWINGS

Figure 1:
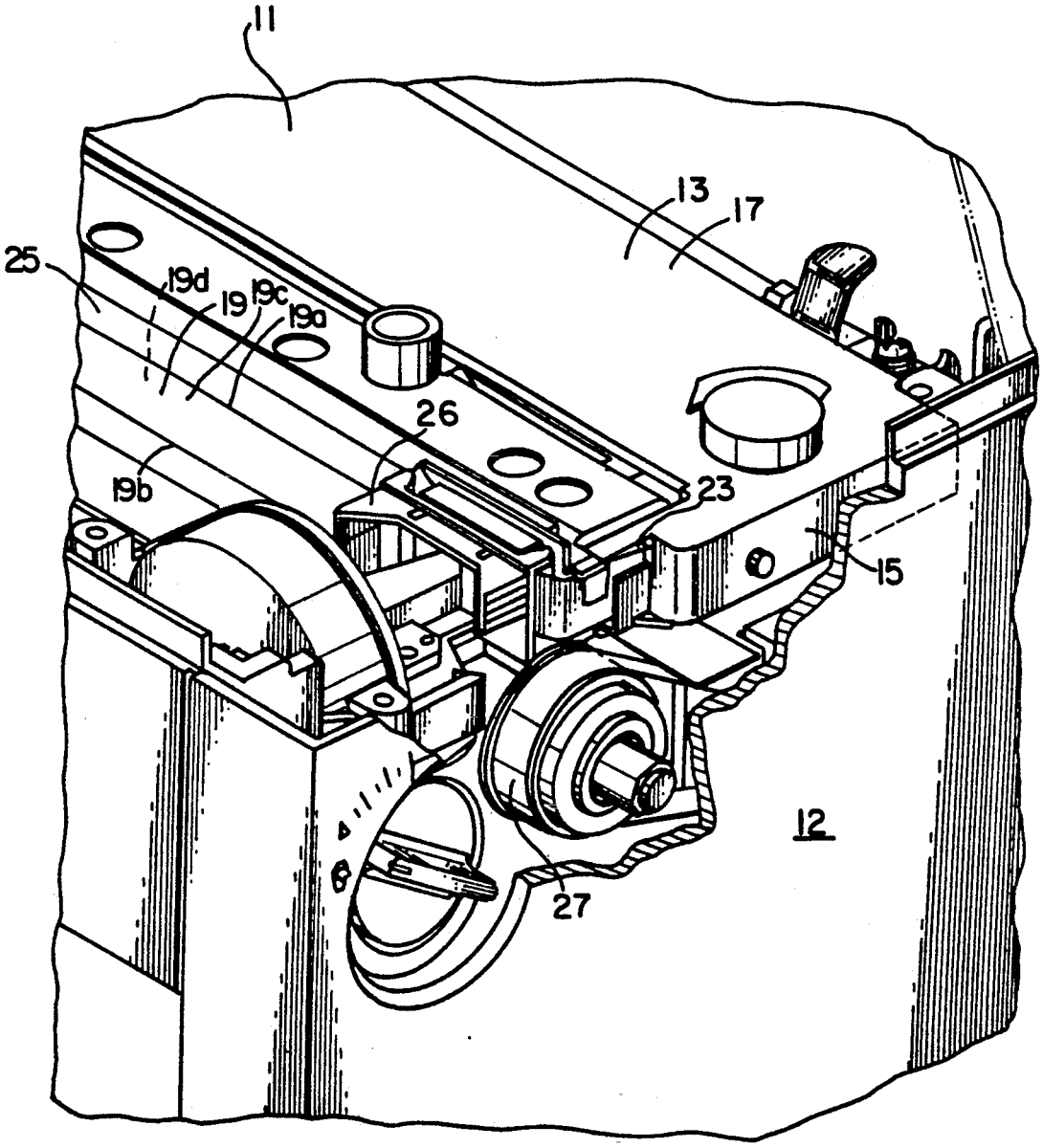
FIG. 1 is a partial view in three dimensions of a printer having installed in place a ribbon cartridge which has a take-up arm constructed in accordance with this invention.
Figure 3:
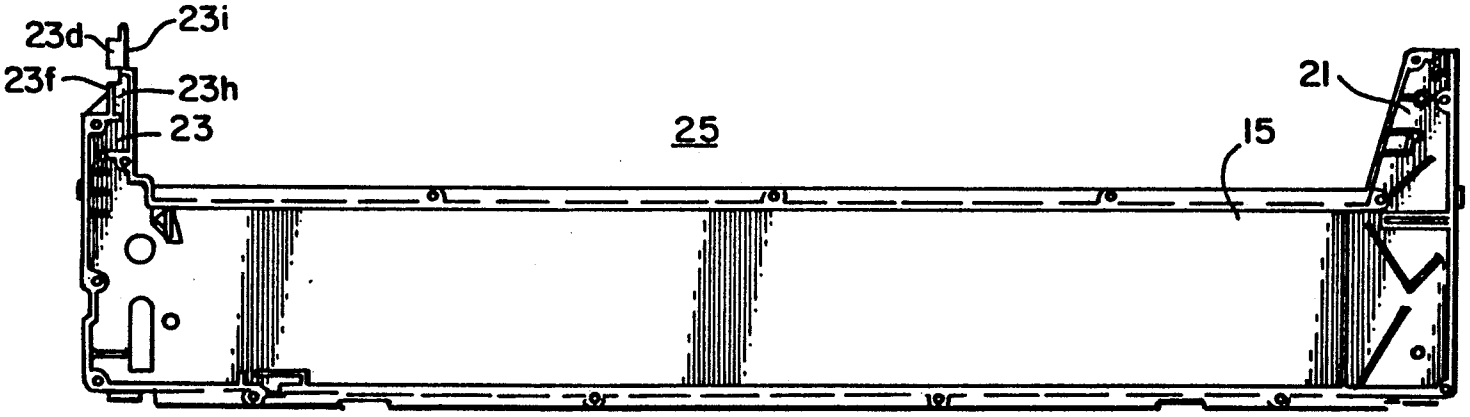
FIG. 3 is a top plan view of the case of the ribbon cartridge.
Figure 4:
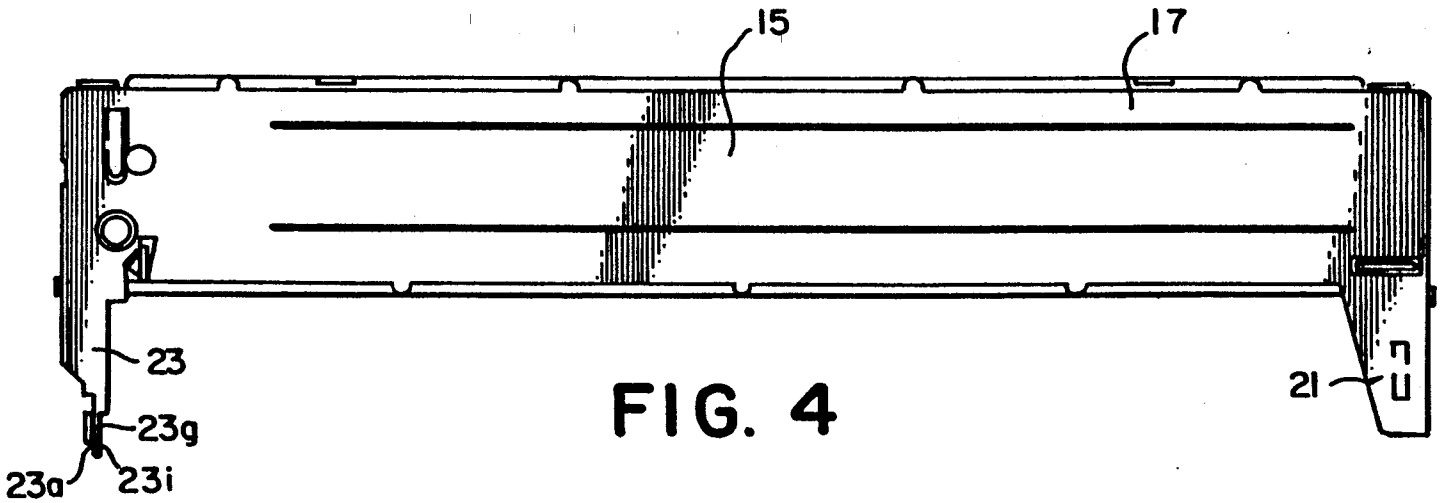
FIG. 4 is a top plan view of a cover for the ribbon cartridge case of FIG. 3.

Turning now to the drawings, there is shown a ribbon cartridge or cassette 11 installed in a printer 12. Cartridge 11 comprises an enclosed housing 13 formed by a case 15 and a cover 17. A ribbon 19 having an upper edge 19*a* and a lower edge 19*b*, is stuffed inside the housing 13 which has an output arm 21 formed at one side and a take-up arm 23 formed at the other side in the cartridge 11. Arms 21 and 23 are spaced apart and ribbon 19 extends between them to allow for printing. A print space 25 is formed between output arm 21 and take-up arm 23 and space 25 is where the dot matrix head of the printer types onto the ribbon 19 and onto the paper. A floating ribbon guide 26 is mounted on ribbon 19 between the arms 21 and 23 and holds the ribbon 19 in proper position for printing.

Before this take-up arm 23 was invented, there was no way of reliably routing the ribbon 19 between ribbon guide 26 and the combination pulley/gear 27 of the printer, due to the extremely tight space in that area of the printer.

Referring to FIG. 2, which shows the take-up arm 23 more clearly since the pulley/gear 27 has been removed, and referring also to FIG. 5, the take-up arm 23 is thin and includes a support stub 24 which extends forwardly from the bottom 23*b* of the forward end 23*c* of take-up arm 23 to support the bottom edge 19*b* of ribbon 19 as it turns the corner during operation.

An upper guide finger 23*d* extends from an outer face 23*a* of take up arm 23 and opposes a lower guide finger 23*f* of the take-up arm 23. Upper guide finger 23*d* forms an upper slot 23*g* and lower guide finger 23*f* forms a lower slot 23*h*. Slots 23*g* and 23*h* capture the ribbon 19 and keep it from escaping during installation and during operation of the printer 12. The shape of the upper guide 23*d* and the lower guide 23*f* allows it to fit between gears or rollers from the top and bottom of a printer. Inner surface 23*i* is offset to provide space for ribbon guide 26 to reciprocate between both arms 21 and 23.

During operation of the printer 12, the ribbon 19 is pulled through ribbon guide 26 and is passed above support stub 24 as it rounds the corner, through upper slot 23*g* of upper guide finger 23*d*, through lower slot 23*h* of lower guide finger 23*f*, and then into the cartridge 11.

We claim:

1. A ribbon cartridge (11) for a printer (12) adapted to print onto a sheet(s) of paper (or other similar media), comprising an enclosed housing (13) formed by a case (15) and a cover (17), a ribbon (19) stuffed in the housing (13), said ribbon (19) having an upper edge (19*a*) and a lower edge (19*b*), said ribbon (19) having an outer surface (19*c*) adapted to face away from a paper sheet(s) (or other similar media) positioned in the printer (12) and having an inner surface (19*d*) adapted to face toward the paper sheet(s) (or other similar media) in the printer (12), an output arm (21) formed in the housing (13) from which the ribbon (19) exits the cartridge (11), a take-up arm (23) formed in the housing (13) which receives the ribbon (19) into the ribbon cartridge (11), said take-up arm (23) being spaced away from the output arm (21) to form a print space (25) therebetween, said take-up arm (23) having an outer face (23*a*) with a bottom portion (23*b*), and an inner surface (23*i*) to fit between combination pulley/gear (27) and ribbon guide (26) and to allow reliable routing of the ribbon (19) during operation, a support stub (24) which extends forwardly from the bottom portion (23*b*) of the forward end (23*c*) of the take-up arm (23) to support the lower edge (19*b*) of the ribbon (19), an upper guide finger (23*d*) which extends from the take-up arm (23) and forms an upper slot (23*g*) with outer face (23*a*) of take-up arm (23) for receiving and guiding the upper edge (19*a*) of the ribbon (19), a lower guide finger (23*f*) on the take-up arm (23) which forms a lower slot (23*h*) with outer face (23*e*) of take-up arm (23) for receiving and guiding the lower edge (19*b*) of the ribbon (19), said upper and lower guide fingers (23*d*), (23*f*) being positioned so as to not interfere with components of the printer (12).

2. The ribbon cassette of claim 1, said upper and lower guide fingers (23*d*) (23*f*) being spaced apart from each other.

* * * * *